US006156982A

United States Patent [19]

Dawson

[11] Patent Number: 6,156,982

[45] Date of Patent: Dec. 5, 2000

[54] LOW CURRENT HIGH TEMPERATURE SWITCH CONTACTS

[75] Inventor: Arthur Wayne Dawson, Freeport, Ill.

[73] Assignee: Honeywell Inc., Morristown, N.J.

[21] Appl. No.: 09/405,627

[22] Filed: Sep. 24, 1999

[51] Int. Cl.[7] ..... H01H 1/04; H01H 1/06

[52] U.S. Cl. ..... 200/263; 200/268; 200/275

[58] Field of Search ..... 200/262, 263, 200/266–268, 270, 271, 275, 278, 279

[56] References Cited

U.S. PATENT DOCUMENTS

| | | | |
|---|---|---|---|
| 3,573,812 | 4/1971 | Pihl | 340/373 |
| 3,819,896 | 6/1974 | Aidn et al. | 200/166 J |
| 4,129,763 | 12/1978 | Murata | 200/159 A |
| 4,163,125 | 7/1979 | Boulanger | 200/5 A |
| 4,216,358 | 8/1980 | Brozille | 200/67 D |
| 4,220,835 | 9/1980 | Storz et al. | 200/67 DB |
| 4,644,115 | 2/1987 | Nishimori et al. | 200/67 D |
| 5,422,451 | 6/1995 | Herklotz | 200/269 |
| 5,712,611 | 1/1998 | Mattes et al. | 337/334 |
| 5,818,002 | 10/1998 | Kurtz et al. | 200/834 |

*Primary Examiner*—Michael Friedhofer
*Attorney, Agent, or Firm*—Kris T. Fredrick; Andrew A. Abeyta

[57] ABSTRACT

A low ampere mechanical switch has a contact design creating a line of contact between the moveable and stationary contacts. The stationary contacts are stainless steel and the moveable contact is Inconel™. Both contacts have a thin plating of gold alloy to provide for good mechanical strength at high temperature with a natural lubricating ability. The contact physical design provides good wiping action and mechanical contact while preventing troughing.

15 Claims, 2 Drawing Sheets

LOW CURRENT HIGH TEMPERATURE SWITCH CONTACTS

BACKGROUND OF THE INVENTION

1. Field of the Invention

The invention relates generally to low ampere-high temperature switches. The invention relates more specifically to the contact designs for such switches.

2. Description of Prior Art

Mechanical switches for carrying low current at high temperature are often problematic. Low current is generally meant to include the range of 0.001 to 0.050 amp. High temperature is generally meant to include 500° F.–900° F. High temperature prevents the use of certain plating materials, due to softening, and the low current does not provide sufficient energy, or spark, at the contacts to burn away contaminants that can occur on all contact materials except the most noble materials.

Because many plating materials become soft at high temperatures, troughing of the contact point, wherein a groove is formed in the mating surfaces as seen in FIG. 1, may occur on the softer of the contact surfaces, typically the moveable contact which is often plated with a thicker layer of a noble material such as gold. Troughing causes loss of wiping action when the moveable contact 13 makes contact with the stationary contact 15. Loss of wiping means contaminants will not be moved away from the contact area, resulting in less efficient current flow. Troughing is exacerbated by plating thickness where most softening of contact material occurs. Troughing also increases the mechanical contact movement which can change operating characteristics. Mechanical interlocking of the contacts in the trough also can cause complete loss of switch function.

Therefore, it would be desirable to have a switch design which can retain good electrical contact characteristics while operating at low current and high temperatures, and be resistant to the softening and troughing problems just described.

SUMMARY OF THE INVENTION

The present invention is constructed and arranged to have a moveable contact which is a flat blade. The stationary contacts are rectangular or cylindrical bars presenting a single edge of contact to the moveable blade. The stationary contacts are stainless steel covered with thin plating of suitably hardened gold. The moveable contact is a quality high strength material such as Inconel™ covered with the thin hardened gold plating. By the use of thin plating at all contact points, the gold will act as a conducting lubricant without troughing, in order to maintain good electrical characteristics. The line contact between stationary and moveable contacts provides suitable wiping with this type of plating.

DESCRIPTION OF PREFERRED EMBODIMENTS

Figure 1:
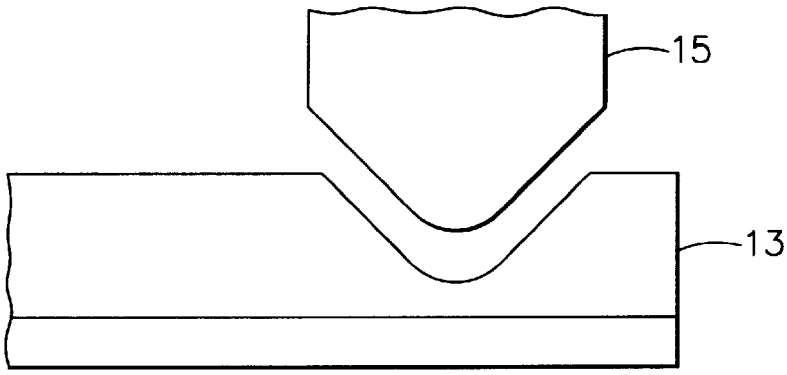
FIG. 1 (PRIOR ART)
FIG. 1 shows a prior art flat blade moveable contact with thick plating and the troughing effect against a conical or single edge stationary contact.
Figure 2:
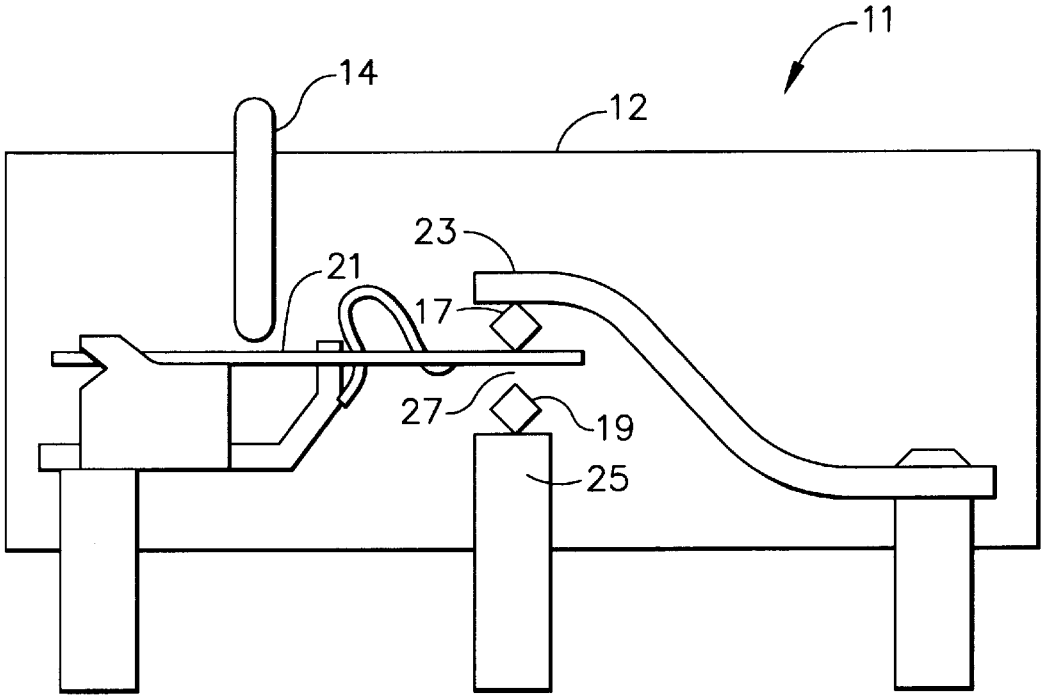
FIG. 2 is a side view of a first preferred embodiment of the present invention.
Figure 3:
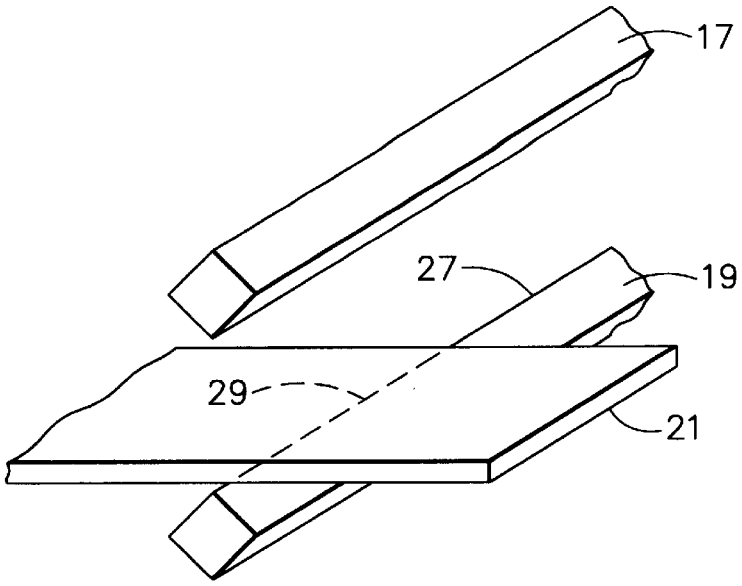
FIG. 3 is a perspective view of the contacts of FIG. 2.

As seen in FIG. 2, a side view of a snap action switch is shown as a single pole double throw (SPDT) switch 11 with a case 12; plunger 14; a snap spring, common, moveable contact 21; and normally open 19 and normally closed 17 stationary contacts. According to the preferred embodiment, the stationary contacts 17, 19 of the SPDT switch 11 are bars of roughly square, or rectangular, cross section. The moveable contact 21 is a flat blade. While shown as one piece, the blade could be bifurcated. The stationary contacts 17, 19 are mounted on their posts 23, 25 respectively, by welding or other known attachment means, to present an edge, e.g. 27 to the moveable contact 21. The edge 27 concentrates the force of the moveable contact 21 along a single line 29 (FIG. 3) to provide good wiping action to scrub away contaminants and/or particulates when the moveable contact meets the stationary contacts. The line of contact 29 further provides a sufficient area of contact for electrical connection as the contact plating is scrubbed away, as further explained below.

Figure 4:
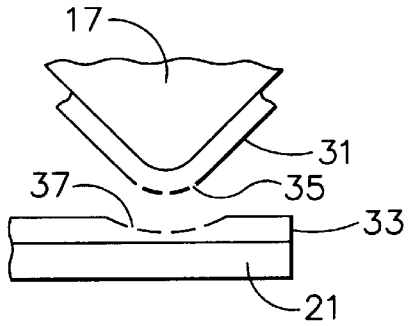
FIG. 4 illustrates the shallow wear of the plating in the preferred embodiment.

As seen in FIG. 4, the stationary contact 17 is a stainless steel bar covered with a thin plating 31, of about 150 micro-inches or less, of cobalt hardened gold or similar hardened noble contact material. Pure gold is too soft at higher temperatures and silver or silver alloys also soften and being less noble, can accumulate contact films that low currents cannot overcome. The moveable contact 21 is preferably composed of Inconel (Trademark) or like material and is likewise covered with a similar thin plating 33 of hardened gold. As the moveable and stationary contacts make repeated contact at high temperatures the softened gold plating will wear, as at lines 35 and 37, under the scrubbing forces, but the plating is too thin to present a danger of excessive troughing. It is believed that the softened gold plating, in essence, acts as a conducting lubricant for both the stationary contact and the moveable contact at the line of their contact. The stainless steel and Inconel™ members provide physical stability for the switch.

Testing has shown that switching characteristics for the described embodiment are stable in the high temperature range at a ten milliamp load.

Figure 5:
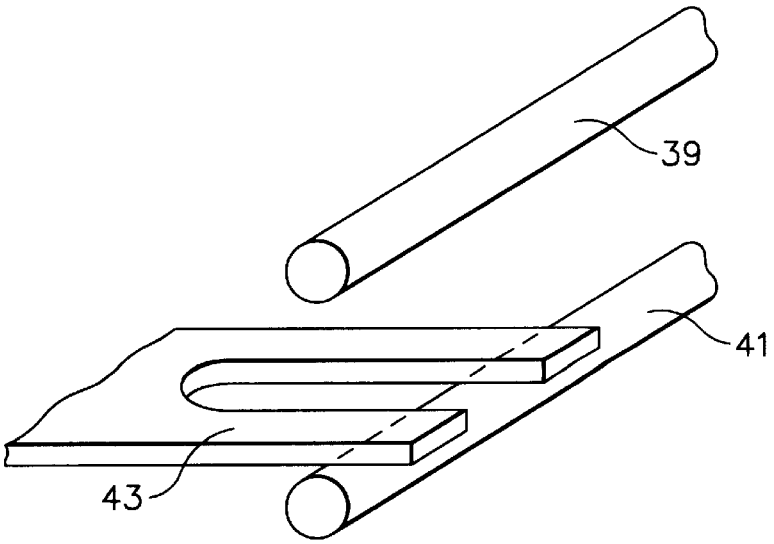
FIG. 5 shows an alternative embodiment of the present invention using cylindrical stationary contacts with a bifurcated snap spring.

As seen in FIG. 5, bars of round or oval cross section 39, 41 may also be suitably used for stationary contacts since such a shape promotes the preferred line contact and wiping action between the stationary and moveable contacts. A bifurcated moveable contact 43 might further be suitably used.

It will be appreciated by the ordinarily skilled artisan that many variations may exist under the teachings of the present invention and that the invention is to be limited only by the appended claims.

What is claimed is:

1. A low current, high temperature electrical switch contact design comprising:

a stationary contact and a moveable contact;

the stationary contact being shaped and mounted so as to present an area of line contact to the moveable contact;

the stationary contact being composed of a stainless steel body having a hardened gold plating thereon of about 150 micro-inches thickness or less; and the moveable contact being a flat blade composed of a nickel iron alloy body having a hardened gold plating thereon of about 150 micro-inches thickness or less.

2. The contacts according to claim 1, wherein the Ni—Fe alloy is Inconel (Trademark).

3. The contacts according to claim 1, wherein the stationary contact has a round or oval cross section.

4. The contacts according to claim 1, wherein the stationary contact has a rectangular cross section.

5. The contacts according to claim 1, wherein the, moveable contact is bifurcated.

6. The contact design of claim 1, further comprising a second stationary contact placed in opposition to said stationary contact.

7. The contacts according to claim 1, wherein the stationary contact has a square cross section.

8. A low current, high temperature electromechanical switch comprising:

a) a stationary contact and a moveable contact;

b) the stationary contact being shaped and mounted so as to present an edge to the moveable contact;

c) the stationary contact being composed of a stainless steel body having a hardened gold plating thereon of about 150 micro-inches thickness or less; and d) the moveable contact being a flat blade composed of a nickel iron alloy body having a hardened gold plating thereon of about 150 micro-inches thickness or less;

e) a plunger for causing movement of the moveable contact between the stationary contact and the moveable contact; and f) a case for enclosing the contacts and a portion of the plunger.

9. The switch of claim 8, wherein the Ni—Fe alloy is Inconel™.

10. The switch of claim 8, wherein the stationary contact has a round cross section.

11. The switch of claim 8, wherein the stationary contact has a rectangular cross section.

12. The switch of claim 8, wherein the moveable contact is bifurcated.

13. The switch of claim 8, further comprising a second stationary contact placed in opposition to said stationary contact.

14. The switch of claim 8, wherein the stationary contact has a square cross section.

15. The switch of claim 8, wherein the stationary contact has an oval cross section.

* * * * *